US006296979B1

(12) United States Patent
Morita et al.

(10) Patent No.: US 6,296,979 B1
(45) Date of Patent: Oct. 2, 2001

(54) SOUND DEADENING MEMBER FOR ELECTROPHOTOGRAPHIC PHOTORECEPTOR AND ELECTROPHOTOGRAPHIC PHOTORECEPTOR USING THE SAME

(75) Inventors: Shoichi Morita; Masaru Miura, both of Minamiashigara; Hiroshi Kitani; Yutaka Igarashi, both of Ube, all of (JP)

(73) Assignees: Fuji Xerox Co., Ltd., Tokyo (JP); Ube Cycon Ltd., Yamaguchi (JP)

( * ) Notice: Subject to any disclaimer, the term of this patent is extended or adjusted under 35 U.S.C. 154(b) by 0 days.

(21) Appl. No.: 09/603,971

(22) Filed: Jun. 26, 2000

(30) Foreign Application Priority Data

Jul. 1, 1999 (JP) ..... 11-187899

(51) Int. Cl.[7] ..... G03G 5/10
(52) U.S. Cl. ..... 430/69; 399/16
(58) Field of Search ..... 399/164; 430/69

(56) References Cited

U.S. PATENT DOCUMENTS 5,816,724 * 10/1998 Hada et al. ..... 400/656

FOREIGN PATENT DOCUMENTS

-A-6-41443 2/1994 (JP) .

* cited by examiner

*Primary Examiner*—John Goodrow
(74) *Attorney, Agent, or Firm*—Oliff & Berridge, PLC

(57) ABSTRACT

A sound deadening member for electrophotographic photoreceptor composed of a molded thermoplastic resin composition obtained by compounding at least 10 parts by weight of a copolymer (A) having a glass transition point of at least 40° C. and being made of from 10 to 90% by weight (meth)acrylic acid ester monomer(s) and not more than 90 parts by weight of a styrene-base resin (B) such that the sum total becomes 100 parts by weight and an electrophotographic photoreceptor having the sound deadening member for electrophotographic photoreceptor in the inside of the conductive substrate.

10 Claims, 1 Drawing Sheet

SOUND DEADENING MEMBER FOR ELECTROPHOTOGRAPHIC PHOTORECEPTOR AND ELECTROPHOTOGRAPHIC PHOTORECEPTOR USING THE SAME

BACKGROUND OF THE INVENTION

1. Field of the Invention

The present invention relates to a sound deadening member for electrophotographic photoreceptor having an excellent vibration damping property, a high rigidity, a shock resistance, and a good working balance and to an electrophotographic photoreceptor using it.

2. Description of the Related Art

Recently, the tendency of requiring a comfortability of the living environment becomes active and vibration damping and the reduction of noise from instruments in the living environment have been required. Particularly, in office instruments, domestic electrical appliances, sound instruments, etc., higher tone qualities have been required. Also, because from the change of a mode of life, domestic electrical appliances such as refrigerators, washing machines, cleaners, etc., become large-sized, whereby the vibrations and noises generated by these electric appliances become large, in these products, the quietness by low vibration and low noise becomes one of the important performances of the commodities.

In these products, in the office instruments such as copying machines, printers, etc., the reduction of noises and vibrations generated from these instruments has become an important problem for keeping a good work and good living environment. In these office instruments, because in particularly a photoreceptor portion which is the printing portion of an electrophotography such as an electrophotographic copying machine and printer, etc., a high frequency giving the most unpleasant feeling to human beings is liable to generate from the mechanism thereof, as the counterplan therefor, a sound deadening part is formed and various investigations have been made about the structure, etc.

That is, as shown in FIG. 1, the photoreceptor of a copying machine is constituted of a photoreceptor drum 1 having a photosensitive layer formed by coating a photosensitive material on the surface of a pipe made of iron, aluminum, etc., and having a plain surface for keeping the uniformity as the photoreceptor, and the photosensitive layer is electrostatically charged by applying thereto a direct current or an alternating current, or a direct current and an alternating current by an electrostatically charging device 2 and printing is carried out. The charging device 2 has the construction that an elastic layer made of a urethane rubber, a styrene-butadiene rubber, an ethylene-butadiene rubber, a nitrile rubber, or a mixture thereof is formed on the outside of a core material made of iron, aluminum, etc., and the elastic layer may be a single layer or plural layers. The alternating current applied by the charging device 2 is desirably from 1.5 to 1.6 kV but may be from 1.0 to 2.0 kV. The frequency of the applying alternating current depends upon the rotation speeds of the charging device 2 and the photoreceptor drum 1.

At printing, by the charging device 2, a vibration is given to the photoreceptor drum 1 according to the frequency in the case of applying an alternating current, whereby the photoreceptor drum 1 generates a noise. The noise becomes a large vibration of the applied frequency or an integer times thereof, and particularly, the frequency of from 1000 to 3000 Hz is perceived as a jarring sound. Thus, a sound deadening member 3 is fixed to the inside wall of the photoreceptor drum 1 for the noise prevention. In order that the sound deadening member 3 is easily inserted in the inside of the photoreceptor drum 1 and is easily released therefrom, and also is closely fixed to the inside wall surface of the photoreceptor drum 1, in the sound deadening member 3, a cut portion 3A of at least 0.5 mm is formed at one portion of the cylindrical cross section and a hinge portion 3B having a thickness of not thicker than ½ of the general thickness of the sound deadening member 3 is formed, and the outside diameter of the sound deadening member 3 is the diameter that when the sound deadening member 3 is fixed to the inside wall surface of the photoreceptor drum 1, all the outside portions of the sound deadening member 3 is brought into contact with the inside wall surface of the photoreceptor drum without forming a gap.

Also, vibration damping resin members suitable for vibration damping of the metal portion of the sound deadening part have been investigated and a resin having sufficient vibration damping property, rigidity and shock resistance, and being suitable for the recycling property of considering the environmental problem in the recent increasing environmental consciousness has been required.

Under these circumstances, styrene-base resins such as, typically, a PS resin, an AS resin (or an SAN resin), an HIPS resin, an ABS resin, an AAS resin, an AES resin, etc., are excellent in the moldability, the shock resistance, the appearance, the weather resistance, etc., and have been widely used for the above-described products, etc., while selecting each resin according to the necessary characteristics. However, these resins are poor in the vibration damping performance, whereby lowering the vibration and the noises cannot be sufficiently attained, and thus, the improvement of the point has been earnestly desired.

On the other hand, as plastics having a high vibration damping performance, polyolefin-base resins are known but because these resins cause a warp at molding and show a large molding shrinkage, there is a problem that these resins are unsuitable for the use requiring a high dimensional accuracy, such as office instruments, etc. As the counterplan for the point of the dimensional accuracy, materials compounded with an inorganic filler have been investigated but there is a problem that by compounding of an inorganic filler, the vibration damping performance is deteriorated.

Also, as a vibration insulator and a vibration damper, it is desirable that the structure itself has a vibration decaying property but because a material having a high rigidity, such as a styrene-base resin which can generally become a structural body and a material having a large vibration damping factor, such as a rubber composition such as, typically, a rubber vibration insulator are in the relation of antinomy that the former has a small vibration damping factor, while the latter has a low rigidity, it is difficult to use a resin composition having a vibration damping performance as a structural body.

As the counterplan thereof, Japanese Patent Laid-Open No. 41443/1994 proposes a mixture of a copolymer having a glass transition point of at least 0° C. made of an acrylic acid ester monomer and/or a methacrylic acid ester monomer and other monomer and other thermoplastic resin. In the proposed invention, because the resin composition contains an acrylic acid ester-base copolymer having a relatively low glass transition point, a property very near a rubber is imparted to the resin composition in a room temperature environment and as the result thereof, a vibration damping property is realized. Accordingly, in the resin composition, under a high-temperature environment, a vibration damping property is obtained to a certain extent but at a temperature near room temperature and a low-temperature region, the vibration damping property and other properties are insufficient, and a stable vibration damping performance cannot be obtained in a wide frequency region, such as particularly, the vibration damping property at a high frequency region of giving unpleasant feeling to human beings is inferior. Therefore, the resin composition is not for practical use and is particularly unsuitable for a sound deadening member for an electrophotographic photoreceptor wherein the vibration damping property in a high frequency region is regarded to be important.

SUMMARY OF THE INVENTION

The present invention has been made in view of the above-described circumstances and provides a sound deadening member for an electrophotographic photoreceptor, which is excellent in the mechanical strengths such as the shock resistance, the rigidity, etc., is excellent in the molding working properties such as the molding fluidity, etc., and is particularly excellent in the vibration damping property and the vibration absorbing property.

Furthermore, the invention also provides an electrophotographic photoreceptor causing less generation of noises.

An aspect of the present invention is a sound deadening member for an electrophotographic photoreceptor composed of a molded thermoplastic resin composition containing at least 10 parts by weight of a copolymer (A) having a glass transition point of at least 40° C., said copolymer being composed of from 10 to 90% by weight an acrylic acid ester monomer and/or a methacrylic acid ester monomer and from 90 to 10% by weight other monomer, and not more than 90 parts of a styrene-base resin (B) (wherein, the sum total of the copolymer (A) and the styrene-base resin (B) is 100 parts by weight).

As a result of various investigation for improvement of the vibration damping property of a styrene-base resin having a high rigidity and being suitable as a structural body, the present inventors have found that by the resin composition of the above-described formulation, a sound deadening member for an electrophotographic photoreceptor, which is imparted with an excellent vibration damping property, has a high rigidity, and has a good balance of the shock resistance and the workability is obtained, and have accomplished the present invention.

In the sound deadening member for an electrophotographic photoreceptor of the invention described above, it is preferred that the other monomer constituting the copolymer (A) includes an aromatic vinyl monomer. Furthermore, it is preferred that the other monomer includes a vinyl cyanide monomer.

In the invention, it is preferred that the styrene-base resin (B) is composed of a copolymer (b-1) containing an aromatic vinyl monomer, a vinyl cyanide monomer, and, if necessary, other monomer copolymerizable with these monomers and/or a rubber-containing graft polymer (b-2) obtained by copolymerizing a monomer mixture containing an aromatic vinyl monomer and a vinyl cyanide monomer in the existence of a rubbery polymer.

Also, it is preferred that the thermoplastic resin composition in the invention described above is compounded with an inorganic filler (C) and further with a polyorganosiloxane compound (D).

Furthermore, it is preferred that the thermoplastic resin composition in the invention contains from 10 to 80 parts by weight of the copolymer (A) and from 90 to 20 parts by weight of the styrene-base resin (B) and also it is preferred that the styrene-base resin (B) is made of from 5 to 85% by weight the copolymer (b-1) and from 95 to 15% by weight the rubber-containing graft copolymer (b-2).

Also, it is preferred that the total contents (S) of the monomer units made of the acrylic acid ester monomer and/or the methacrylic acid ester monomer in the copolymer (A) and the styrene-base resin (B) is $10<(S)<70$ (% by weight) in the thermoplastic resin composition.

Another aspect of the invention is an electrophotographic photoreceptor constituted of an electrically conductive support having a cylindrical form and having in the inside thereof the sound deadening member of the invention described above.

BRIEF DESCRIPTION OF THE DRAWING

Preferred embodiments of the present invention will be described in detail based on the following figures, wherein:

FIGS. 1A–1C are schematic cross-sectional views showing the construction of a sound deadening member 3 of a photosensitive receptor, wherein:

FIG. 1A is a cross-sectional view cut along the central axis of the photosensitive receptor drum 1;

FIG. 1B is a cross-sectional view along the direction crossing to the central axis of the photosensitive receptor drum 1 at a right angle; and FIG. 1C is a cross-sectional view of a sound deadening member 3.

DESCRIPTION OF THE PREFERRED EMBODIMENTS

Figure 1A:
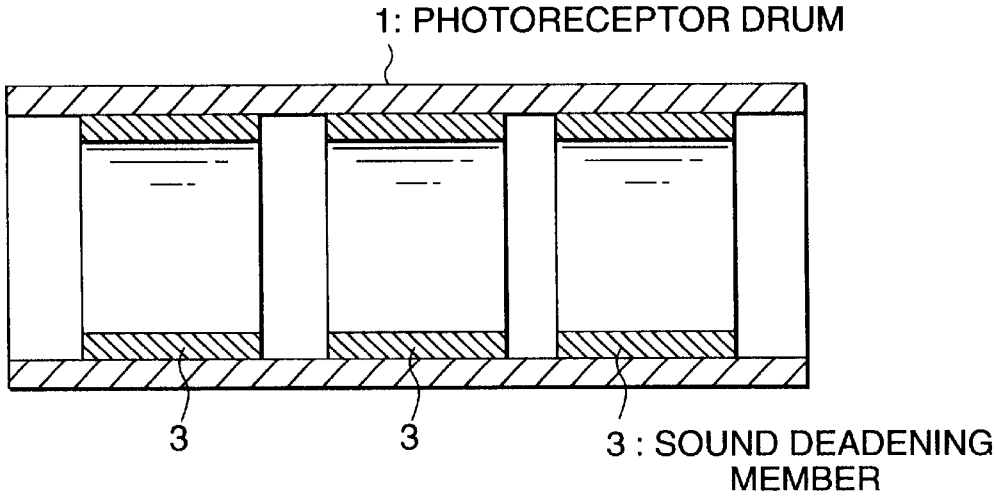

Then, the embodiments of the present invention are described in detail.

First, the thermoplastic resin composition which is the molding material of the sound deadening member for an electrophotographic photoreceptor of this invention is explained.

The acrylic acid ester monomer and the methacrylic acid ester monomer constituting the copolymer (A) in the invention include methyl acrylate, ethyl acrylate, n-butyl acrylate, iso-butyl acrylate, n-nonyl acrylate, iso-nonyl acrylate, methyl methacrylate, ethyl methacrylate, n-butyl methacrylate, iso-butyl methacrylate, n-nonyl methacrylate, iso-nonyl methacrylate, pentyl acrylate, pentyl methacrylate, hexyl acrylate, hexyl methacrylate, heptyl acrylate, heptyl methacrylate, 2-ethylhexyl acrylate, 2-ethylhexyl methacrylate, octyl acrylate, octyl methacrylate, n-nonyl acrylate, iso-nonyl acrylate, etc. These monomers can be used singly or as a mixture of two or more kinds of them. In these monomers, as the acrylic acid ester monomer and the methacrylic acid ester monomer used in the invention, methyl acrylate and methyl methacrylate are particularly preferred.

The above-described acrylic acid ester monomer and/or methacrylic acid ester monomer is contained in the copolymer (A) in an amount of from 10 to 90% by weight, preferably from 20 to 90% by weight, and more preferably from 40 to 80% by weight. When the content is less than 10% by weight, the vibration damping effect is low, while when the content exceeds 90% by weight, both the vibration damping property and shock resistance are deteriorated, which are undesirable.

Also, it is preferred that the other monomer constituting the copolymer (A) includes an aromatic vinyl monomer and examples of the aromatic vinyl monomer include styrene, α-methylstyrene, para-methylstyrene, bromostyrene, etc., and in these monomers, styrene and α-methylstyene are particularly preferred. Also, it is preferred that the other monomer further includes a vinyl cyanide monomer and examples of the vinyl cyanide monomer include acrylonitrile, methacrylonitrile, etc. In these monomers, acrylonitrile is particularly preferred. These aromatic vinyl monomers and the vinyl cyanide monomers may be used singly or as a mixture of two or more kinds of them.

As described above, the copolymer (A) further contains, if necessary, a monomer copolymerizable with the above-described monomers and as such a copolymerizable monomer, there are maleimide compounds, unsaturated carboxylic acids, etc. The maleimide compounds include N-phenylmaleimide, N-cyclohexylmaleimide, etc. The unsaturated carboxylic acids include acrylic acid, methacrylic acid, itaconic acid, fumaric acid, etc. These monomers may be also used singly or as a mixture of two or more kinds of them.

It is preferred that in the copolymer (A), the content of the aromatic vinyl monomer is from 5 to 40% by weight, the content of the vinyl cyanide monomer is from 1 to 30% by weight, and the content of the monomer which is use if necessary is not more than 20% by weight.

Also, the glass transition point of the copolymer (A) is at least 40° C., preferably at least 50° C., and more preferably at least 60° C. When the copolymer (A) having a glass transition point of lower than 40° C. is used, the rigidity is lowered and the improving effect of the vibration damping property is insufficient. In addition, in the invention, the glass transition point of the copolymer (A) was measured using a differential heat scanning calorimeter (DSC, trade name, manufactured by Seiko Instruments Inc.).

Also, the weight average molecular weight of the copolymer (A) is preferably from 10,000 to 250,000, more preferably from 50,000 to 250,000, and particularly preferably from 50,000 to 150,000. When the weight average molecular weight of the copolymer (A) is within the above-described range, the more improving effect of the vibration damping property can be obtained.

The styrene-base resin (B) in the invention is composed of a copolymer (b-1) made of an aromatic vinyl monomer, a vinyl cyanide monomer, and, if necessary, other monomer copolymerizable with these monomers, and/or a rubber-containing graft copolymer (b-2) obtained by copolymerizing a monomer mixture containing an aromatic vinyl monomer and a vinyl cyanide monomer in the existence of a rubbery polymer.

In this case, the copolymer (b-1) is made of a hard copolymer obtained by copolymerizing an aromatic vinyl monomer, a vinyl cyanide monomer, and, if necessary, other monomer copolymerizable with these monomers. The aromatic vinyl monomer include styrene, α-methylstyrene, para-methylstyrene, bromostyrene, etc., and in these monomers, styrene and α-methylstyrene are particularly preferred. Also, the vinyl cyanide monomer includes acrylonitrile, methacrylonitrile, etc., and in these monomers, acrylonitrile is particularly preferred. As other monomer copolymerizable with the above-described monomers, there are acrylic acid ester monomers, methacrylic acid ester monomers, maleimide compounds, unsaturated carboxylic acids, etc. In these monomers, the (meth)acrylic acid ester monomers include methacrylic acid esters and acrylic acid esters such as methyl methacrylate, methyl acrylate, etc. The maleimide compounds include N-phenylmaleimide, N-cyclohexylmaleimide, etc. The unsaturated carboxylic acids include acrylic acid, methacrylic acid, itaconic acid, fumaric acid, etc. These vinylic monomers may be also used singly or as a mixture of two or more kinds of them.

It is preferred that in the copolymer (b-1), the content of the aromatic vinyl monomer is from 50 to 85% by weight, the content of the vinyl cyanide monomer is from to 50% by weight, and the content of other monomer copolymerizable with these monomers is not more than 25% by weight.

Also, the weight average molecular weight of the copolymer (b-1) is preferably from 10,000 to 250,000, more preferably from 50,000 to 250,000, and particularly preferably from 100,000 to 250,000. When the weight average molecular weight of the copolymer (b-1) is within the range, the more improving effect of the vibration damping property is obtained.

For example, because in a sound deadening member for an electrophotographic photoreceptor, etc., not only the resin itself used for the sound deadening member is required to have a vibration damping property but also the structural body of the electrophotographic photoreceptor provided with the sound deadening member is required to have a vibration damping property, it is necessary that the distance between the member and a metal portion mounting the member is highly controlled, and for the purpose, the resin is required to have a highly precise moldability as the resin performance. Accordingly, in the invention, it is preferred that the weight average molecular weight of the copolymer (b-1) is within the above-described range.

The rubber-containing graft copolymer (b-2) in the invention is a copolymer obtained by graft-polymerizing an aromatic vinyl monomer, a vinyl cyanide monomer, and, if necessary, other monomer in the existence of a rubber polymer and/or a mixture of the copolymer and a homopolymer or copolymer of the above-described monomers to be graft-polymerized to the rubber polymer.

The rubbery polymer in the rubber-containing graft copolymer (b-2) includes polybutadiene, a copolymer of butadiene and copolymerizable vinyl monomer, an acrylic acid ester polymer, a copolymer of an acrylic acid ester polymer and a copolymerizable vinyl monomer, an ethylene-propylene or butene-non-conjugated diene copolymer, polyorganosiloxane, etc.

In this case, the acrylic acid ester polymer includes methyl acrylate, ethyl acrylate, propyl acrylate, butyl acrylate, isobutyl acrylate, pentyl acrylate, isoamyl acrylate, n-hexyl acrylate, 2-methylpentyl acrylate, 2-ethylhexyl acrylate, n-octyl acrylate, etc. Also, the diene contained in the ethylene-propylene-non-conjugated diene copolymer described above includes dycyclpentadiene, 1,4-hexadiene, 1,4-heptadiene, 1,5-cyclooctadiene, 6-methyl-1,5-heptadiene, 11-ethyl-1,11-tridecadiene, 5-methylene-2-norbornene, etc., and they can be used singly or as a mixture of two or more kinds thereof.

As the rubbery polymer, in the polymers illustrated above, an acrylic acid ester-base polymer obtained by crosslinking an acrylic acid ester monomer with a multifunctional crosslinking agent such as triallyl isocyanurate, etc., is particularly preferably used because in the case, the vibration damping performance can be increased in the general regions of from a low-frequency region to a high-frequency region.

The rubber content in the rubber-containing graft copolymer (b-2) is preferably from 30 to 70% by weight. When the rubber content is less than 30% by weight, the shock resistance becomes inferior, while the rubber content exceeds 70% by weight, the bending modulus of elasticity is lowered, which are undesirable.

The vinylic monomers, which are graft-polymerized with the rubber polymer for forming the rubber-containing graft copolymer (b-2), are an aromatic vinyl monomer, a vinyl cyanide monomer, and, if necessary, other monomer copolymerizable with these monomers and as these aromatic vinyl monomer, vinyl cyanide monomer, and, other monomer copolymerizable with these monomers, which is used if necessary, the same monomers as the vinylic monomers used for the copolymer (b-2) described above can be used.

It is preferred that in the rubber-containing graft copolymer (b-2), the content of the aromatic vinyl monomer is from 20 to 50% by weight, the content of the vinyl cyanide monomer is from 5 to 25 % by weight, and the content of the other monomer is not more than 25 % by weight.

The thermoplastic resin composition in the invention contains at least 10 parts by weight of the above-described polymer (A) and not more than 90 parts by weight of the above-described styrene-base resin (B) such that the sum total thereof becomes 100 parts by weight. When the content of the copolymer (A) is less than 10 parts by weight and the content of the styrene-base resin (B) exceeds 90 parts by weight, the vibration damping effect is lowered. In the case of considering the properties of the molded article obtained, such as the shock resistance, etc., it is preferred that the copolymer (A) is from 10 to 80 parts by weight and the styrene-base resin (B) is from 90 to 20 parts by weight, it is more preferred that the copolymer (A) is from 25 to 80 parts by weight and the styrene-base resin (B) is from 75 to 20 parts by weight, it is far more preferred that the copolymer (A) is from 45 to 80 parts by weight and the styrene-base resin (B) is from 55 to 20 parts by weight, and it is particularly preferred that the copolymer (A) is from 55 to 75 parts by weight and the styrene-base resin (B) is from 45 to 25 parts by weight.

Also, it is preferred that the styrene-base resin (B) is composed of from 5 to 85% by weight the copolymer (b-1) and from 95 to 15% by weight the rubber-containing graft copolymer (b-2). When the content of the copolymer (b1) is less than 5% by weight, the vibration damping property at the high-frequency region is lowered. On the other hand, the content thereof exceeds 85 parts by weight, the vibration damping property is generally lowered. Also, when the content of the rubber-containing graft copolymer (b-2) is less than 15% by weight, the shock resistance is lowered and also in the case of mounting in the photoreceptor as a sound deadening member for an electrophotographic copying machine photoreceptor, a hinge effect is not obtained, the sound deadening member is cracked at inserting it in the photoreceptor, and the adhesion with the photoreceptor drum portion becomes deficient, and as the result thereof, the sound deadening property of the photoreceptor portion is not obtained. Also, in the case of applying the sound deadening member to the member for the vibration damping counterplan of the photoreceptor portion, a hinge effect is not obtained, the sound deadening member is cracked at inserting it in the photoreceptor, and the adhesion with the photoreceptor drum portion becomes deficient, and as the result thereof, the sound deadening property of the photoreceptor portion is not obtained. Also, when the content of the rubber-containing graft copolymer (b-2) exceeds 95% by weight, the bending modulus of elasticity is lowered and as the case may be, the sound deadening member cannot be used as a structural body.

It is preferred that the styrene-base resin (B) is composed of from 5 to 85% by weight the copolymer (b-1) and from 95 to 15% by weight the rubber-containing graft copolymer (b-2), it is more preferred that the styrene-base resin (B) is composed of from 15 to 70% by weight the copolymer (b1) and from 85 to 30% by weight the rubber-containing graft copolymer (b-2), and it is particularly preferred that the styrene-base resin (B) is composed of from 30 to 70% by weight the copolymer (b1) and from 70 to 30% by weight the rubber-containing graft copolymer (b-2).

Also, it is preferred in the point of the improving effect of the vibration damping property that the thermoplastic resin composition in the invention is further compounded with an inorganic filler (C). Furthermore, it is preferred in the point of the more improving effect of the vibration damping property that the compounded amount of the inorganic filler (C) is from 5 to 30 parts by weight to 100 parts by weight of the sum total of the copolymer (A) and the styrene-base resin (B).

The inorganic filler (C) used in the invention includes glass fibers, glass flakes, glass beads, hollow glass beads, glass mild fibers, mica, talc, calcium carbonate, kaolin, silica, carbon fibers, potassium titanate whisker, zinc oxide whisker, aluminum borate whisker, wollastonite, aluminum hydroxide, magnesium hydroxide, etc., and they can be used singly or as a mixture of two or more kinds thereof. In these materials, as the inorganic filler (C), calcium carbonate, mica, and talc are preferred and calcium carbonate and talc are particularly preferred.

The inorganic filler (C) is compounded in an amount of preferably from 5 to 30 parts by weight, more preferably from 5 to 25 parts by weight, and particularly preferably from 10 to 25 parts by weight to 100 parts by weight of the sum total of the copolymer (A) and the styrene-base resin (B). When the compounding amount of the inorganic filler (C) is less than 5 parts by weight, the vibration damping property is insufficient and a part requiring high-precise molding, a sufficient dimensional precision is not obtained. Also, when the compounding amount exceeds 30 parts by weight, the shock resistance is lowered as well as the vibration damping property is undesirably lowered.

The most preferred compounded embodiment of the inorganic filler (C) is the combination of calcium carbonate (C-1) and talc (C-2) and in the combination, it is preferred that the content of calcium carbonate (C-1) is from 50 to 98% by weight in the sum total of calcium carbonate (C-1) and talc (C-2).

In this case, calcium carbonate having fine particle size is good, and the particle size thereof is preferably from 1 to 50 $\mu$m, more preferably from 1 to 40 $\mu$m, and particularly preferably from 1 to 30 $\mu$m. As the form of calcium carbonate, an acicular form is more preferred than a cubic form, etc.

In the thermoplastic resin composition containing 100 parts by weight of the sum total of the copolymer (A) and the styrene-base resin (B) described above, and in preferably the thermoplastic resin composition further compounded with from 5 to 30 parts by weight of the inorganic filler (C) to 100 parts of the sum total thereof, the vibration damping property and various other properties are greatly improved as compared with a styrene-base resin of prior art, and also in the invention, by further containing polyorganosiloxane, the vibration damping property can be further improved. In particular, by compounding from 0.01 to 10 parts by weight of a polyorganosiloxane compound (D) to 100 parts by weight of the sum total of the copolymer (A) and the styrene-base resin (B), an excellent synergistic effect of the three components (A), (B), and (D) is obtained, and the vibration damping property can be greatly improved.

There is no particular restriction on the polyorganosiloxane compound (D) if the compound is a polymer having a polysiloxane bond and examples of the compound include polydimethylsiloxane, polydiphenylsiloxane, polymethylphenylsiloxane, etc. From the view points of the cost and easily availability, polydimethylsiloxane is preferred.

Also, there is no particular restriction on the viscosity of the polyorganosiloxane compound (D) for the vibration damping performance, but the viscosity of the polyorganosiloxane compound (D) at 25° C. is preferably from 100 to 30,000 centistokes, more preferably from 500 to 20,000 centistokes, and particularly preferably from 500 to 15,000 centistokes. When the viscosity of the polyorganosiloxane compound (D) is lower than 100 centistokes, the vibration damping property may be good, but bread out causes on the molded articles and silver streaks, etc., are liable to occur at injection molding, which are undesirable. Also, when the viscosity exceeds 30,000 centistokes, kneading of the polyorganosiloxane compound (D) with the resin composition becomes difficult, whereby a uniform resin composition is hard to produce.

The addition amount of the polyorganosiloxane compound (D) is from 0.01 to 10 parts by weight, preferably from 0.05 to 5 parts by weight, and more preferably from 0.1 to 5 parts by weight to 100 parts by weight of the sum total of the copolymer (A) and the styrene-base resin (B). When the addition amount of the polyorganosiloxane compound (D) is less than 0.01 part by weight, the synergistic effect of compounding the three components (A), (B), and (D) is not obtained, while when the addition amount exceeds 10 parts by weight, a uniform resin composition is hard to obtain and also the mechanical properties are lowered.

Also, in the thermoplastic resin composition of the invention, the total amount (S) of the monomer units made of the acrylic acid ester monomer and/or the methacrylic acid ester monomer (hereinafter, is referred to as "(meth) acrylic acid ester monomer total contents") contained in the copolymer (A) and the styrene-base resin (B) is preferably 10% by weight<(S)<70% by weight, more preferably 20% by weight<(S)<60% by weight, and particularly preferably 30% by weight<(S)<60% by weight. When the total contents are less than 10% by weight, the vibration damping property at a high frequency may be excellent but the vibration damping property at a low frequency is liable to be lowered, while the total contents exceed 70% by weight, the vibration damping property at a low frequency may be excellent, but the vibration damping property at a high frequency is liable to be lowered. When the total contents are from 10 to 70% by weight, regardless of the frequency region, a good vibration damping property can be maintained.

The thermoplastic resin composition of the invention can be imparted desired characteristics by mixing with other thermoplastic resin(s). In this case, other plastic resins which can be mixed with the thermoplastic resin composition of the invention include polyamide resins such as nylon-6, nylon-66, nylon-12, nylon-46, etc.; unsaturated polyester resins such as polyethylene terephthalate, polybutylene terephthalate, polyarylate, etc.; polycarbonate resins; polyphenylene oxide resins; polyphenylene sulfide resins; polyolefins such as polyethylene, polypropylene, etc.; rubber-containing styrene resins; SAN resins, etc. They can be used singly or as a mixture of two or more kinds thereof. From the view point of compatibility, saturated polyester resins such as polyethylene terephthalate, polybutylene terephthalate, etc.; the polycarbonate resins; the polyphenylene oxide resins; and the polymethyl methacrylate resins are preferably used, and they can be used singly or as a mixture of two or more kinds thereof.

In this case, the above-described other thermoplastic resin can be compounded in an amount of from 11 to 900 parts by weight to 100 parts by weight of the sum total of the copolymer (A) and the styrene-base resin (B). When the compounding amount is less than 11 parts by weight or exceeds 900 parts by weight, the compatibility of the thermoplastic resin composition with other thermoplastic resin (s) is lowered, whereby lowering of the properties and layer-form releasing undesirably occur.

Also, the thermoplastic resin composition of the invention can be imparted with a flame retardant property by compounding with a flame retardant (E). As the flame retardant (E), compounds generally used as a flame retardant of polymers such as rubbers, resins, etc., can be used. Examples of the flame retardant include halogen-containing compounds, phosphorus-containing compounds, nitrogen-containing compounds, silicon-containing compounds, etc.

The above-described halogen-containing compounds include tetrabromobisphenol A derivatives such as tetrabromobisphenol A, tetrabromobisphenol A-bis(2-hydroxyethyl ether), tetrabromobisphenol A-bis(2,3-dibromopropyl ether), etc.; hexabromodiphenyl ether; octabromodiphenyl ether; decabromodiphenyl ether; bis(tribromophenoxy) ethane; hexabromocyclododecane; etc.

Also, there are oligomer type halogen-containing compounds obtained by polymerizing monobromophenol, tribromophenol, pentabromophenol, tribromocresol, dibromopropylphenol, tetrabromobisphenol, etc., or copolymerizing the above monomer and at least one kind selected from the group of the above-described halogen-containing compounds.

Also, there are a polycarbonate oligomer of tetrabromobisphenol A, a polycarbonate oligomer of tetrabromobisphenol A and bisphenol A, a polycarbonate oligomer of tetrabromobisphenol S, a polycarbonate oligomer of tetrabromobisphenol S and bisphenol S , etc. Furthermore, a halogenated epoxy oligomer, etc., can be used.

As the above-described phosphorus-containing compounds, there are organic phosphorus-containing compounds, red phosphorus, phosphezene-base compounds, polyphosphoric acid ammonium ester, etc. In these compounds, organic phosphorus-containing compounds include phosphates such as triphenyl phosphate, etc.; phosphites such as triphenyl phosphite, etc. These organic phosphorus-containing compounds may be used singly or as a mixture of two or more kinds of them.

As the organic phosphorus-containing compound, triphenyl phosphate, triphenyl thiophosphate, trixylenyl phosphate, trixylenyl thiophosphate, hyroxynonbis(diphenyl phosphate), resolcinol(diphenyl phosphate), etc., are particularly preferred.

The above-described nitrogen-containing compounds include triazine, triazolidine, urea, guanidine, amino acid, melamine and the derivatives thereof.

The above-described silicon-containing compounds include organosilane compounds such organosiloxane, etc.; polysilane, etc.

The compounding amount of the above-described flame retardant (E) is from 3 to 50 parts by weight, and preferably from 5 to 40 parts by weight to 100 parts by weight of the sum total of the copolymer (A) and the styrene-base resin (B). When the compounding amount is less than 3 parts by weight, imparting of the flame retardant property is insufficient and when the compounding amount exceeds 50 parts by weight, the shock resistance is greatly lowered, which are undesirable.

Also, to further increase the effect of the flame retardant (E), an antimony-containing compound can be used together. The antimony compound includes antimony trioxide, antimony tetraoxide, antimony pentaoxide, sodium antimonate, etc.

Furthermore, for preventing the occurrence of dripping of flame as burning, a drip preventing agent can be added. As the drip preventing agent, there are chlorinated polyethylene, vinyl chloride resins, polytetrafluoroethylene, etc.

If necessary, the thermoplastic resin composition of the invention can be compounded with various additives such as a pigment, a dye, a lubricant, a ultraviolet absorbent, an antioxidant, an antistatic agent, a reinforcing agent, a filler, etc., within the range of reducing the properties, etc.

There is no particular restriction on the method of producing the thermoplastic resin composition by mixing these constituting components but melt kneading is preferred and, for example, en extruding machine, a bambury mixer, etc., can be used.

Also, there is no particular restriction on the method of producing the sound deadening member for an electrophotographic photoreceptor of this invention by molding the thermoplastic resin composition, and various molding methods, wherein after applying injection molding, blow molding, contour extrusion molding, or extruding into a sheet form, vacuum molding or pressure molding is carried out, can be applied.

Because the sound deadening member for an electrophotographic photoreceptor of the invention is excellent not only in the vibration damping property but also in the shock resistance, the rigidity, and the molding workability, the sound deadening member for an electrophotographic photoreceptor is effective as a member used for the purpose of sound deadening of the electrophotographic photoreceptor drum portion of a copying machine, etc., which is required to have these properties.

Then, the sound deadening member for an electrophotographic photoreceptor of this invention produced with the thermoplastic resin composition as described above is explained by referring to FIG. 1.

Figure 1B:
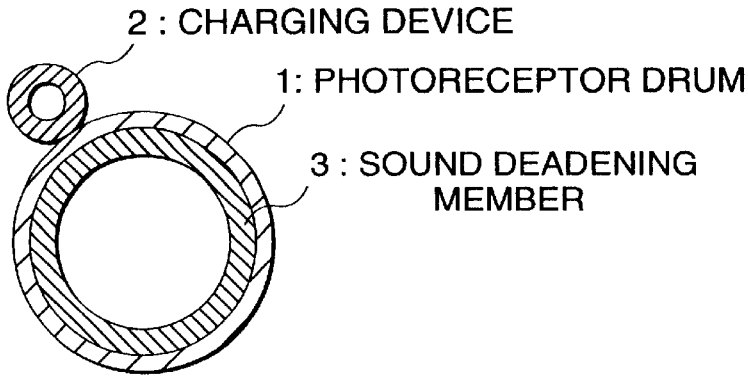
Figure 1C:
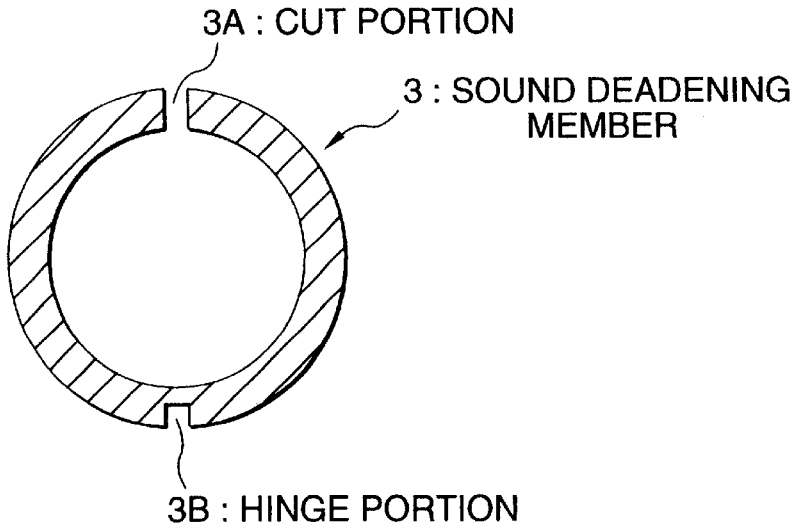

FIG. 1 is a cross-sectional view showing the construction of a sound deadening member 3 of a photosensitive receptor, wherein FIG. 1A is a cross-sectional view cut along the central axis of the photosensitive receptor drum 1, FIG. 1B is a cross-sectional view along the direction crossing to the central axis of the photosensitive receptor drum 1 at a right angle, and FIG. 1C is a cross-sectional view of a sound deadening member 3.

As described above, the sound deadening member 3 is formed on the inside wall surface of the photoreceptor drum 1, and as shown in FIG. 1C, a cut portion 3A and a hinge portion 3B are formed for closely adhering to the inside wall surface of the photoreceptor drum. The sound deadening member 3 may one of covering a part of the inside wall surface of the photoreceptor drum or may in integrate wide body of covering the whole inside wall surface of the photoreceptor. There is no particular restriction on the number of the sound deadening members in the inside of the photoreceptor drum and may be one or plural. When the sound deadening member is one, it is preferred that the sound deadening member is formed in the inside of the photoreceptor at a place wherein the center of gravity of the photoreceptor drum substantially coincides with the center of gravity of the sound deadening member. Also, when the number of the sound deadening member is plural, it is effective to dispose the sound deadening members such that the sound deadening members become symmetrical to the lengthwise direction of the photoreceptor drum. For example, as shown in FIG. 1A, the sound deadening member 3 divided into plural portions may be disposed in the axis direction of the photoreceptor drum 1. As shown in FIG. 1A, by forming the sound deadening member 3 divided into plural portions, the number of the sound deadening members inserted in the inside of the photoreceptor drum 1 can be controlled according to the level of the noise, whereby a desired sound deadening performance can be preferably obtained.

In the sound deadening member 3, a cut portion 3A is usually formed as shown in FIG. 1C and when there is a space of the cut portion 3A, the insertion, mounting, and detaching of the sound deadening member in or from the photoreceptor drum 1 can be easily carried out.

Also, as shown in FIG. 1C, by forming a hinge portion 3B, the insertion, mounting, and detaching of the sound deadening member in or from the photoreceptor drum 1 can be easily carried out and also the tension force or the adhesion thereof to the inside surface of the photoreceptor drum 1 at contacting the sound deadening member to the inside wall surface of the photoreceptor drum 1 can be properly maintained. Joining of such a sound deadening member 3 to the inside wall surface of the photoreceptor drum 1 is maintained by the tension force utilizing the elasticity of the sound deadening member 3 but they may be more strongly adhered each other using an adhesive.

In the case of using such a sound deadening member 3, there are no particular restriction on the side and the thickness of the photoreceptor drum 1 but usually, the thickness of the photoreceptor drum is from about 1.5 to 6.0 mm.

In addition, there is no particular restriction on the construction of the photosensitive layer of the photoreceptor drum 1, and the photosensitive layer may be plural-layer construction such as a charge generating layer, a charge transport layer, etc., or may be a single-layer construction.

Also, the construction of the charging device 2 and other constructions are as described above.

Then, the present invention is more practically explained using the following synthetic examples, the experiment examples, the comparative experiment examples, the examples, and the comparative examples, but the invention is not limited to these examples within the scope of the invention.

In addition, in the following descriptions, the parts are parts by weight and the weight average molecular weights of the copolymer (A) and the copolymer (b-1) are calculated by a standard polystyrene conversion method using GPC (gel•permeation•chromatography); manufactured by TOSOH CORPORATION.

SYNTHESIS EXAMPLES 1 TO 6

Production of Copolymers (A-1) to (A-6):

Each of the (meth)acrylic acid ester-base copolymers (A-1) to (A-6) having the weight average molecular weights shown in Table 1 below is synthesized by a known emulsion polymerization at the ratios shown in Table 1. The glass transition points Tg of the copolymers obtained are measured using a differential heat scanning calorimeter (DSC: manufactured by Seiko Instruments Inc.) and the values obtained are shown in Table 1.

TABLE 1

| | A-1 | A-2 | A-3 | A-4 | A-5 | A-6 |
|---|---|---|---|---|---|---|
| Methyl methacrylate | 60 | 50 | 40 | 65 | | 98 |
| Methyl acrylate | 10 | | | 25 | | |
| n-butyl acrylate | | | | | 50 | |
| Styrene | 30 | 30 | 30 | 7 | 30 | 2 |
| Acrylonitrile | | 20 | 15 | 3 | 20 | |
| α-methylstyrene | | | 15 | | | |
| Molecular weight* | 12.3 | 13.2 | 14.7 | 9.5 | 8.8 | 10.5 |
| Glass transition point Tg (° C) | 93 | 104 | 114 | 79 | 24 | 105 |

*: Weight average molecular weight

SYNTHESIS EXAMPLE 7

Production of Copolymer (b-1-1):

In a nitrogen-replaced reaction vessel is placed monomer a mixture of 120 parts of water, 0.002 part of sodium alkylbenzenesulfonate, 0.5 part of polyvinyl alcohol, 0.3 part of azoisobutyronitrile, 30 parts of acrylonitrile, and 70 parts of styrene, after heating the mixture at an initial temperature of 60° C. for 5 hours, the temperature is raised to 120° C., and after carrying out the temperature for 4 hours, the copolymer obtained is recovered. The weight average molecular weight of the copolymer is 166,000.

SYNTHESIS EXAMPLE 8

Production of Copolymer (b-1-2):

By following the same procedure as Synthesis Example 7 except that 20 parts of acrylonitrile, 30 parts of styrene, 10 parts of a-methylstyrene, 30 parts of methyl methacrylate, and 10 parts of N-phenylmaleimide, a copolymer is synthesized. The weight average molecular weight of the copolymer obtained is 123,000.

SYNTHESIS EXAMPLE 9

Production Rubber-Containing Graft Copolymer (b-2-1):

| [Formula] | |
|---|---|
| Styrene (ST) | 30 parts |
| Acrylonitrile (AN) | 10 parts |
| Polybutadiene.latex | 60 parts |
| Disproporionated potassium rosinate | 1 part |
| Potassium hydroxide | 0.03 part |
| Tert-dodecylmercaptan (t-DM) | 0.1 part |
| Cumene hydroperoxide | 0.3 part |
| Ferrous sulfate | 0.007 part |
| Sodium pyrophosphate | 0.1 part |
| Dextrose | 0.3 part |
| Distilled water | 190 parts |

In an autoclave are placed distilled water, disproportionated potassium rosinate, potassium hydroxide, and a polybutadiene•latex, after heating the added mixture to 60° C., ferrous sulfate, sodium pyrophosphate, and dextrose are added to the mixture, while keeping the temperature at 60° C., ST, AN, t-DM, and cumene hydroperoxide are continuously added thereto over a period of 2 hours, thereafter, the temperature is raised to 70° C., and the resultant mixture is maintained at the temperature for one hour to finish the reaction. To the ABS latex obtained by the reaction is added an antioxidant, thereafter, the mixture is solidified with sulfuric acid, and after sufficiently washing with water, the product is dried to obtained an ABS graft copolymer (b-2-1).

SYNTHESIS EXAMPLE 10

Production of Rubber-Containing Copolymer (b-2-2):

By following the same procedure as Synthesis Example 9 except that 10 parts of acrylonitrile is reacted with 30 parts of styrene in the existence of 60 parts of a polybutyl acrylate rubber (crosslinked using triallyl isocyanurate as a crosslinking agent), an AAS graft copolymer (b-2-2) is obtained.

In addition, for comparison, a general ABS resin (T: manufactured by Ube Sycone Co., Ltd.) is used. Also, as the component (C), calcium carbonate (C-1) (CACO NS 1000: manufactured by Nitto Funka Kogyo K.K., mean particle size: 1.17 μm) or talc (C-2) (SIMGON: manufactured by Nippon Talc K.K.) is used and as the component (D), dimethylsiloxane (SH200: manufactured by Toray Dow Corning Co., Ltd.; the viscosity at 25° C.: 10,000 centistokes) is used.

EXPERIMENT EXAMPLES 1 TO 6, COMPARATIVE EXPERIMENT EXAMPLES 1 to 5:

After kneading each of the copolymers in the ratio shown in Tables 2 and 3 below with 0.5 part by weight of a lubricant (PRN-208: manufactured by NOF Corporation), the kneaded mixture is melt-kneaded by a twin screw extruder (TEX-44: manufactured by TOSHIBA CORPORATION) at 220° C. to form pellets. The total contents (S) of the (meth)acrylic acid ester monomers in the thermoplastic resin compositions obtained by kneading are as shown in Tables 2 and 3. By molding the pellets using a 4-once injection molding machine (manufactured by THE JAPAN STEEL WORKS. LTD.) at 240° C., each necessary test piece is prepared, each test piece is evaluated as follows, and the results are shown in Tables 2 and 3.

[Melt flow index]

ASTM-D1238 (220° C./10 Kg) (g/10 min.)

[Izod impact strength]

ASTM-D256 (normal temperature) (Kg•cm/cm)

[Bending modulus of elasticity]

ASTM-D790 (normal temperature) ($Kg/cm^2$)

[Vibration damping property]

Using the following measurement apparatus, by a center-support vibration method regulated by JIS G 0602, the mechanical impedance is measured under the following condition, the loss coefficient is calculated by a half-width method.

Measurement apparatus: Vibration damping property evaluation apparatus, manufactured by Matsushita Intertechno Co., Ltd.

Condition: The lost coefficient at each of the frequencies (100, 500, 1200, and 2500 Hz) at 20° C. is measured.

TABLE 2

| | | | Experiment Examples | | | | | |
|---|---|---|---|---|---|---|---|---|
| | | | 1 | 2 | 3 | 4 | 5 | 6 |
| Formulation (weight parts) | A-1 | | 50 | 50 | 50 | | | |
| | A-2 | | | | | 50 | | |
| | A-3 | | | | | | 50 | |
| | A-4 | | | | | | | 75 |
| | A-5 | | | | | | | |
| | A-6 | | | | | | | |
| | b-1-1 | | 30 | 30 | 30 | 30 | 30 | |
| | b-1-2 | | | | | | | 20 |
| | b-2-1 | | 20 | 20 | 20 | 20 | 20 | |
| | b-2-2 | | | | | | | 5 |
| | ABS resin | | | | | | | |
| | C-1 | | | 10 | 15 | 15 | 15 | 15 |
| | C-2 | | | 3 | 5 | 5 | 5 | 5 |
| | D-1 | | | | 3 | 3 | 5 | 3 |
| (Meth)acrylic acid ester monomer total contents (S) (wt. %) | | | 35 | 35 | 35 | 25 | 20 | 79 |
| Evaluation results | Melt flow index | | 7 | 14 | 10 | 10 | 9 | 11 |
| | Izod impact strength | | 30 | 13 | 10 | 8 | 7 | 8 |
| | Bending elastic modulus | | 25000 | 27000 | 29000 | 29000 | 28000 | 34000 |
| | Vibration damping property | Loss coefficient 100 Hz | 0.020 | 0.021 | 0.025 | 0.024 | 0.023 | 0.026 |
| | | 500 Hz | 0.020 | 0.022 | 0.026 | 0.025 | 0.024 | 0.025 |
| | | 1200 Hz | 0.021 | 0.023 | 0.027 | 0.026 | 0.025 | 0.023 |
| | | 2500 Hz | 0.021 | 0.023 | 0.028 | 0.027 | 0.027 | 0.022 |

TABLE 3

| | | | Comparative Experimental Examples | | | | |
|---|---|---|---|---|---|---|---|
| | | | 1 | 2 | 3 | 4 | 5 |
| Formulation (weight parts) | A-1 | | 7 | | | | |
| | A-2 | | | | | 50 | |
| | A-3 | | | | | | |
| | A-4 | | | | | | |
| | A-5 | | | 50 | | | |
| | A-6 | | | | 85 | | |
| | b-1-1 | | 15 | 30 | 12 | 20 | |
| | b-1-2 | | | | | | |
| | b-2-1 | | 78 | 20 | 3 | 20 | |
| | b-2-2 | | | | | | |
| | ABS resin | | | | | | 100 |
| | C-1 | | 15 | 10 | 15 | 40 | |
| | C-2 | | 5 | | | | |
| | D-1 | | | | | | |
| (Meth)acrylic acid ester monomer total contents (S) (wt. %) | | | 3.5 | 35 | 83.3 | 25 | — |
| Evaluation results | Melt flow index | | 18 | 3 | 20 | 4 | 23 |
| | Izod impact strength | | 2 | 28 | 3 | 2 | 27 |
| | Bending elastic modulus | | 31000 | 12000 | 33000 | 37000 | 22000 |
| | Vibration damping property | Loss coefficient 100 Hz | 0.015 | 0.18 | 0.028 | 0.16 | 0.015 |
| | | 500 Hz | 0.016 | 0.021 | 0.026 | 0.017 | 0.016 |
| | | 1200 Hz | 0.017 | 0.021 | 0.023 | 0.018 | 0.017 |
| | | 2500 Hz | 0.018 | 0.023 | 0.019 | 0.019 | 0.019 |

From Tables 2 and 3, the following matters can be seen.

As is clear from the results of Experiment Examples 1 to 6, it can be seen that when the formulation is within the scope of the invention, the good mechanical properties and the good vibration damping property are obtained. Also, as is clear from the results of Experiment Examples 3 to 6, it can be seen that by mixing the polyorganosiloxane compound (D), the vibration damping performance is more improved and when the inorganic filler (C) is made of calcium carbonate and talc, and further the polyorganosiloxane compound (D) is mixed, by the excellent synergistic effect obtained, the good vibration damping property is obtained from a low-frequency region to a high-frequency region regardless of the composition of the copolymer (A).

On the other hand, as is clear from Comparative Experiment Example 1, when the mixing ratio of the copolymer (A) and the styrene-base resin (B) made of the copolymer (b-1) and the rubber-containing graft copolymer (b-2) is outside the scope of the invention, the vibration damping property is not obtained or the mechanical characteristic (shock resistance or rigidity) is lowered. Also, as is clear from Comparative Experiment Example 2, when the glass transition point of the copolymer (A) is low, the vibration damping property is lowered and the balance of properties become inferior. Also, from Comparative Experiment Example 3, when the content of methyl methacrylate in the copolymer (A) is more, the mechanical characteristic (shock resistance or rigidity) is lowered.

Also, from Comparative Experiment Example 4, it can be seen that when the content of the inorganic filler (C) is too much, the vibration damping property is lowered.

Furthermore, from Comparative Experiment Example 5, it can be confirmed that in the case of using a general ABS resin, general properties may be good but the vibration damping property is greatly inferior.

EXAMPLES 1 TO 4 AND COMPARATIVE EXAMPLES 1 TO 3

After molding each cylindrical molded article using each of the thermoplastic resin compositions shown in Tables 4 and 5, by forming a cut portion 3A and a hinge portion 3B in each molded article by mechanical working, each sound deadening member 3 (thickness 4.0 mm, diameter 28.4 mm, width 100 mm) as shown in FIG. 1 is produced. Each three members of the sound deadening member thus produced are mounted in the photoreceptor drum having an inside diameter of 28.5 mm of a laser printer ("Laser Press 4410", manufactured by FUJI XEROX CO., LTD.) as shown in FIG. 1A. The noise level generated in the laser printer by mainly a charging device and propagated to the photoreceptor drum is determined by measuring the total sound level at from 30 to 10 kHz at applying an alternating electric current of 1200 Hz using a sound-level meter ("Integration Type Precise Sound-Level Meter NL-14", manufactured by Rion K.K.), and the results are shown in Tables 4 and 5.

Applied voltage:

Alternating current $V_{p\cdot p}$=1.6 kV

Dielectric current $V_{DC}$=0.42 kV

TABLE 4

| Example | Example 1 | Example 2 | Example 3 | Example 4 |
|---|---|---|---|---|
| Thermoplastic Resin Composition Used | Composition of Experiment Example 5 | Composition of Experiment Example 3 | Composition of Experiment Example 4 | Composition of Experiment Example 1 |
| Noise Level (dB) | 44.4 | 43.5 | 44.0 | 47.5 |

TABLE 5

| Examples | Comparative Example 1 | Comparative Example 2 | Comparative Example 3 |
|---|---|---|---|
| Thermoplastic Resin Composition Used | Composition of Comparative Experiment Example 5 | Composition of Comparative Experiment Example 4 | Composition of Comparative Experiment Example 1 |
| Noise Level (dB) | 56.4 | 53.3 | 55.2 |

From the results of Tables 4 and 5, it can be seen that the sound deadening members for photoreceptor of the invention give a good sound deadening effect.

As described above in detail, in the sound deadening member for electrophotographic photoreceptor of the invention, by using the copolymer (meth)acrylic acid ester monomers, the rubber-containing graft copolymer, a hard polymer, and further the inorganic filler and the polyorganosiloxane compound, the faults of a thermoplastic resin molded article of prior art containing a styrene-base resin and a rubbery polymer are improved, and because not only the sound deadening member for electrophotographic photoreceptor of the invention is excellent in the vibration damping property but also in the sound deadening member, the shock resistance, the rigidity, and the molding workability show a good balance in a high state, the sound deadening member of the invention can shows a very excellent performance as the sound deadening member for an electrophotographic photoreceptor.

Furthermore, the electrophotographic photoreceptor using the sound deadening member for electrophotographic photoreceptor of the invention gives the effect of retraining the generation of noises from an apparatus mounting an electrophotographic photoreceptor.

What is claimed is:

1. A sound deadening member for electrophotographic photoreceptor molded from a thermoplastic resin composition, the composition comprising:

at least about 10 parts by weight of a copolymer (A) having a glass transition point of at least about 40° C., the copolymer (A) comprising from about 10 to 90% by weight of an acrylic acid ester monomer and/or a methacrylic acid ester monomer and from about 90 to 10% by weight of other monomer;

not more than about 90 parts by weight of a styrene-base resin (B), the sum total of the copolymer (A) and the styrene-base resin (B) being 100 parts by weight; and wherein the sound deadening member is on a first side of a conductive support member, the conductive support member having a photosensitive layer formed on an opposite side of the conductive support member from the sound deadening member.

2. The sound deadening member for electrophotographic photoreceptor according to claim 1, wherein the other monomer constituting the copolymer (A) includes an aromatic vinyl monomer.

3. The sound deadening member for electrophotographic photoreceptor according to claim 1, wherein the other monomer constituting the copolymer (A) includes a vinyl cyanide monomer.

4. The sound deadening member for electrophotographic photoreceptor according to claim 1, wherein the styrene-base resin (B) comprises a copolymer (b-1) made of an aromatic vinyl monomer, a vinyl cyanide monomer, and, if necessary, other monomer copolymerizable with these monomers and/or a rubber-containing graft polymer (b-2) obtained by copolymerizing a monomer mixture containing an aromatic vinyl monomer and a vinyl cyanide monomer in the existence of a rubbery polymer.

5. The sound deadening member for electrophotographic photoreceptor according to claim 1, wherein the thermoplastic resin composition is compounded with an inorganic filler (C).

6. The sound deadening member for electrophotographic photoreceptor according to claim 1, wherein the thermoplastic resin composition is compounded with a polyorganosiloxane compound (D).

7. The sound deadening member for electrophotographic photoreceptor according to claim 1, wherein the thermoplastic resin composition comprises from about 10 to 80 parts by weight of the copolymer (A) and from 90 to 20 parts by weight of the styrene-base resin (B).

8. The sound deadening member for electrophotographic photoreceptor according to claim 4 wherein the styrene-base resin (B) comprises from about 5 to 85 % by weight the copolymer (b-1) and from about 95 to 15% by weight the rubber-containing graft polymer (b-2).

9. An electrophotographic photoreceptor including a cylindrical conductive support member having formed on the surface thereof a photosensitive layer, the photoreceptor comprising the sound deadening member according to claim 1 inside the conductive support member.

10. The sound deadening member of claim 1, wherein the conductive support member is cylindrical.

* * * * *